United States Patent [19]

Demeny et al.

[11] Patent Number: 4,550,678

[45] Date of Patent: Nov. 5, 1985

[54] APPARATUS FOR REMOVING AN ELECTROSTATIC CHARGE FROM A CHARGE COLLECTOR

[75] Inventors: Gary L. Demeny, Delavan; Robert G. Smead, St. Charles, both of Ill.

[73] Assignee: Caterpillar Tractor Co., Peoria, Ill.

[21] Appl. No.: 660,684

[22] Filed: Oct. 15, 1984

[51] Int. Cl.[4] ..... B05B 5/02

[52] U.S. Cl. ..... 118/630; 118/500

[58] Field of Search ..... 118/630, 500

[56] References Cited

U.S. PATENT DOCUMENTS

| | | | |
|---|---|---|---|
| 3,113,037 | 12/1963 | Watanabe | 117/93.4 |
| 3,937,180 | 2/1976 | Wiggins | 118/635 |
| 4,158,344 | 6/1979 | Bagby et al. | 118/630 |

*Primary Examiner*—Bernard D. Pianalto

*Attorney, Agent, or Firm*—Robert A. McFall

[57] ABSTRACT

An electrostatic coating system includes a non-arcing electrical discharge zone having an approach section in which an elongated conductor connected to ground through a resistor converges towards the path of travel of a charge collector. The system also includes a contact section in which the conductor is adjacent the travel path of collector and the conductor physically contacts the collector as it passes through the contact section of the discharge zone. Conventional charge dissipation systems usually require separate resistors in each workpiece support member or a plurality of mechanically operated switches. The system initially inductively reduces the charge on the workpiece and then establishes electrical contact when a conductor connected to ground through a resistor is at about the same electrical potential as the workpiece and associated charge collector. The system is particularly useful in electrostatic coating systems having limited clearances which would prohibit the placement of a resistor in the workpiece support member.

7 Claims, 3 Drawing Figures

APPARATUS FOR REMOVING AN ELECTROSTATIC CHARGE FROM A CHARGE COLLECTOR

TECHNICAL FIELD

This invention relates generally to electrostatic coating systems and more particularly to an apparatus for removing an electrostatic charge from a charged workpiece in such a system.

BACKGROUND ART

Electrostatic coating systems in which an electrical charge is placed on a workpiece during the coating process are well known. Generally, in such systems, the workpiece is supported on or from a moving conveyor and the electrical charge is transferred to the workpiece from a charge collector mounted for compliant movement with the workpiece. The charge collector may be charged directly by physically contacting a source of electrical potential or inductively charged by being positioned in close proximity to an electrically charged conductor. Examples of the direct contact charging arrangements are shown in U.S. Pat. No. 3,113,037 issued Dec. 3, 1963 to Tamotsu Watanabe and U.S. Pat. No. 3,937,180 issued Feb. 10, 1976 to Richard F. Wiggins. A system having an arrangement for inductively charging a workpiece is shown in U.S. Pat. No. 4,158,344 issued to Thomas L. Bagby, et al and assigned to the assignee of the present invention.

A problem common to all charged-workpiece electrostatic coating systems is dissipation, or removal, of the charge after completion of the coating operation. Watanabe solves the problem by pressing a conductive support rod carrying the charged workpiece against a spring-loaded switch. The switch controls energization of an operating coil in a remotely positioned oil immersed second switch, and thereby completes a conductive path to ground to remove the charge on the support rod and workpiece.

Wiggins addresses the problem of workpiece charge dissipation by sequentially physically contacting a series of spring-loaded buttons each connected to a resistor, the resistors respectively having progressively lower resistance to ground. As the charged workpiece exits the spray zone, a shoe attached to a hanger supporting a workpiece, sequentially contacts the spring-loaded buttons and the charge on the workpiece is incrementally and progressively reduced.

In yet another approach to the problem, Bagby, et al incorporate a bleeder resistor in the workpiece support hanger. The resistor is positioned between a charge collector and a grounded conveyor system thereby allowing the charge on the workpiece and collector to drain to ground shortly after leaving the charging zone. The Bagby, et al arrangement avoids the mechanical switching and multiple contacts required in the earlier Watanabe and Wiggins systems. However, Bagby's positioning of a resistor in the workpiece hanger requires increased hanger length; a limitation that may be undesirable in systems having only limited clearance between the workpiece and conveyor.

The present invention is directed to overcoming the problems set forth above. In particular, a charge removing apparatus constructed according to the present invention eliminates the need for multiple switches and resistors and provides a simplified non-arcing arrangement for dissipating the electrical charge on a workpiece in a controlled manner.

DISCLOSURE OF THE INVENTION

In accordance with one aspect of the present invention, an apparatus for removing an electrostatic charge from a charge collector adapted for travel along a predetermined path, includes an approach section having an inlet end, a spaced second end, and a contact section contiguous with the second end of the approach section. An elongate electrical conductor is mounted on the approach and contact sections. In the approach section, the elongate conductor converges towards the predetermined path of the collectors, being spaced from the path at the inlet end and adjacent the path at the second end. The elongate conductor also extends through at least a portion the contact section and is positioned adjacent the path of the collectors so that as the collectors move through the contact section they physically contact the conductor. An electrical resistor is connected between the conductor and ground.

In another aspect of the present invention, an electrostatic coating system having a conveyor arranged for moving a plurality of workpiece supports along a predetermined path, includes a non-arcing electrical discharge zone arranged so that electrostatic charge collectors mounted on the workpiece supports pass through the discharge zone after passing through a charging zone and receiving an electrostatic charge. The discharge zone includes an elongate electrical conductor connected to ground through a resistor, an approach section having inlet end, a spaced second end, and a contact section adjoining the approach section. A portion of the conductor extends between the inlet and second ends of the approach section in a converging relationship with respect to the predetermined path. At the inlet end of the approach section the conductor is spaced from the path a distance greater than the arcing distance of the electrostatic charge on the collector, and at second end the conductor is at the path. In the contact section, the elongate conductor is positioned so that as the electrical charge collectors pass through the contact zone they are in electrical contact with the conductor substantially along the entire length of the contact section.

BEST MODE FOR CARRYING OUT THE INVENTION

Figure 2:
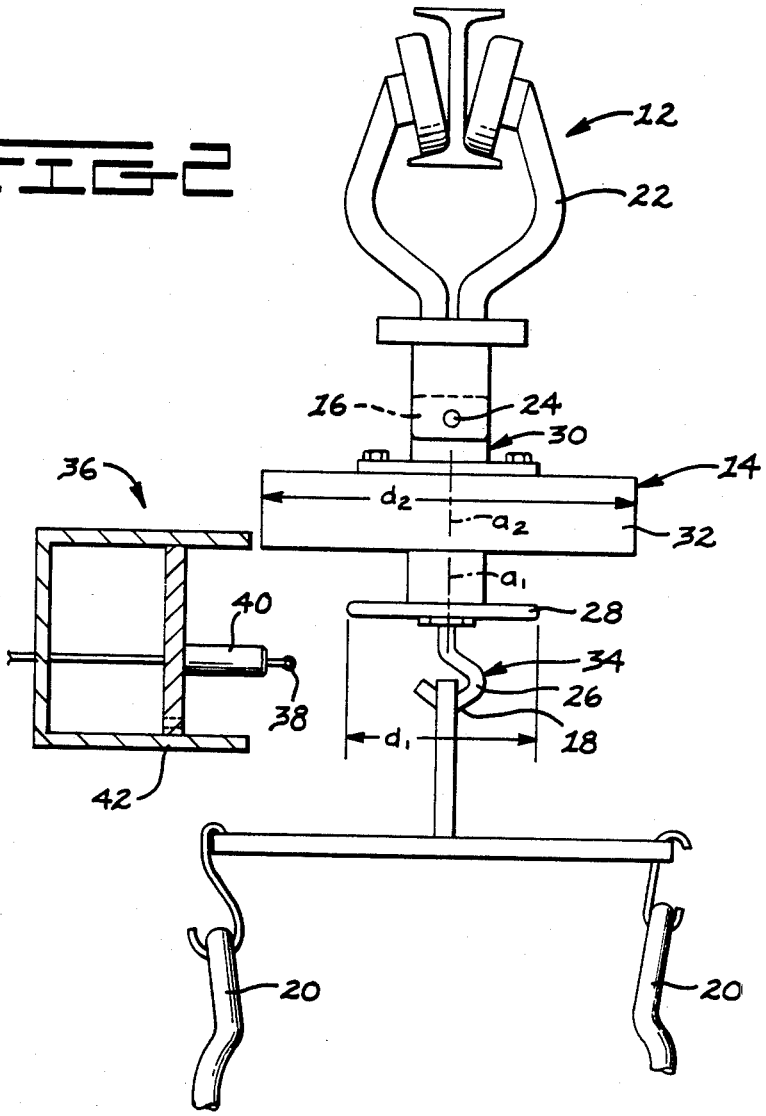
FIG. 2 is a sectional view taken along the line II—II of FIG. 1 showing the charging zone of the electrostatic coating system.
Figure 3:
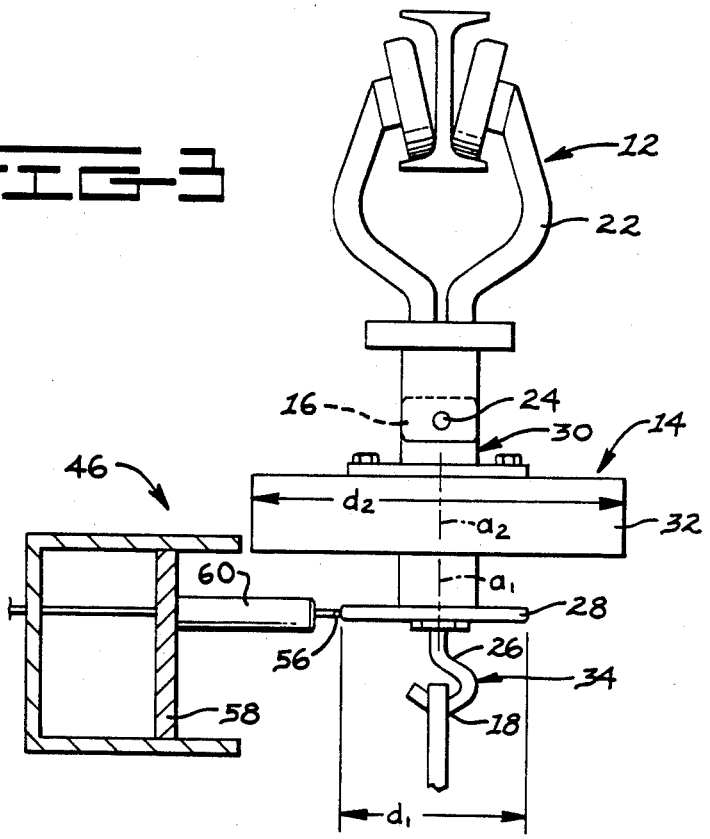
FIG. 3 is a sectional view taken along the line III—III of FIG. 1 showing the discharging zone of the electrostatic coating system.

In the preferred embodiment, an electrostatic coating system 10 includes an overhead conveyor 12 which typically support a plurality of workpiece supports 14 for movement along a predetermined path. As shown in FIGS. 2 and 3, the workpiece supports 14 have a first end 16 that is operatively attached to the conveyor 12 and a second end 18 adapted for supporting one or more workpieces 20 which are to be electrostatically charged and coated. The upper or first end 16 of the workpiece support 14 is pivotally attached to a powered chainlinked roller carrier 22 of the conveyor 12 by a pin 24, or optionally by a ball swivel joint, not shown. The lower, or second end 18 of the workpiece support 14 includes a hook 26 from which a single workpiece may be suspended directly or, as shown in FIGS. 2 and 3, by an intermediate hanger fixture carrying a plurality of workpieces 20.

An electrostatic charge collector 28 is mounted on each of the supports 14 between the first and second ends 16,18. Each of the charge collectors is constructed of an electrically conductive material, and preferably is a substantially planar disc-shaped member having a predetermined diameter $d_1$, and a central axis $a_1$, passing through the midpoint of the diameter $d_1$ perpendicular to the planar surfaces of the collector 14. A first, or upper, portion 30 of each of the supports 14 extends from the charge collector 28 to the first end 16 and is constructed of a non-conductive material such as a glass reinforced epoxy or other dielectric materials. The first portion 30 includes a cylindrically-shaped shield 32 having a diameter $d_2$ that is greater than the diameter $d_1$ of the charge collector 28, and a centrally disposed axis $a_2$ passing through the midpoint of the diameter $d_2$ and coaxially aligned with the central axis $a_1$ of the collector 28.

The workpiece supports 14 include a second portion 34 extending from the charge collector 28 to the second end 18 of the support. The second portion 34 is constructed of an electrically conductive material such as steel to provide a means for electrically connecting each of the charge collectors 28 to a respective workpiece 20. Preferably, the hook 26 is electrically conductive, is attached directly to the charge collector 28 and provides an electrically conductive path between the charge collector and one or more workpieces supported by the hook.

Figure 1:
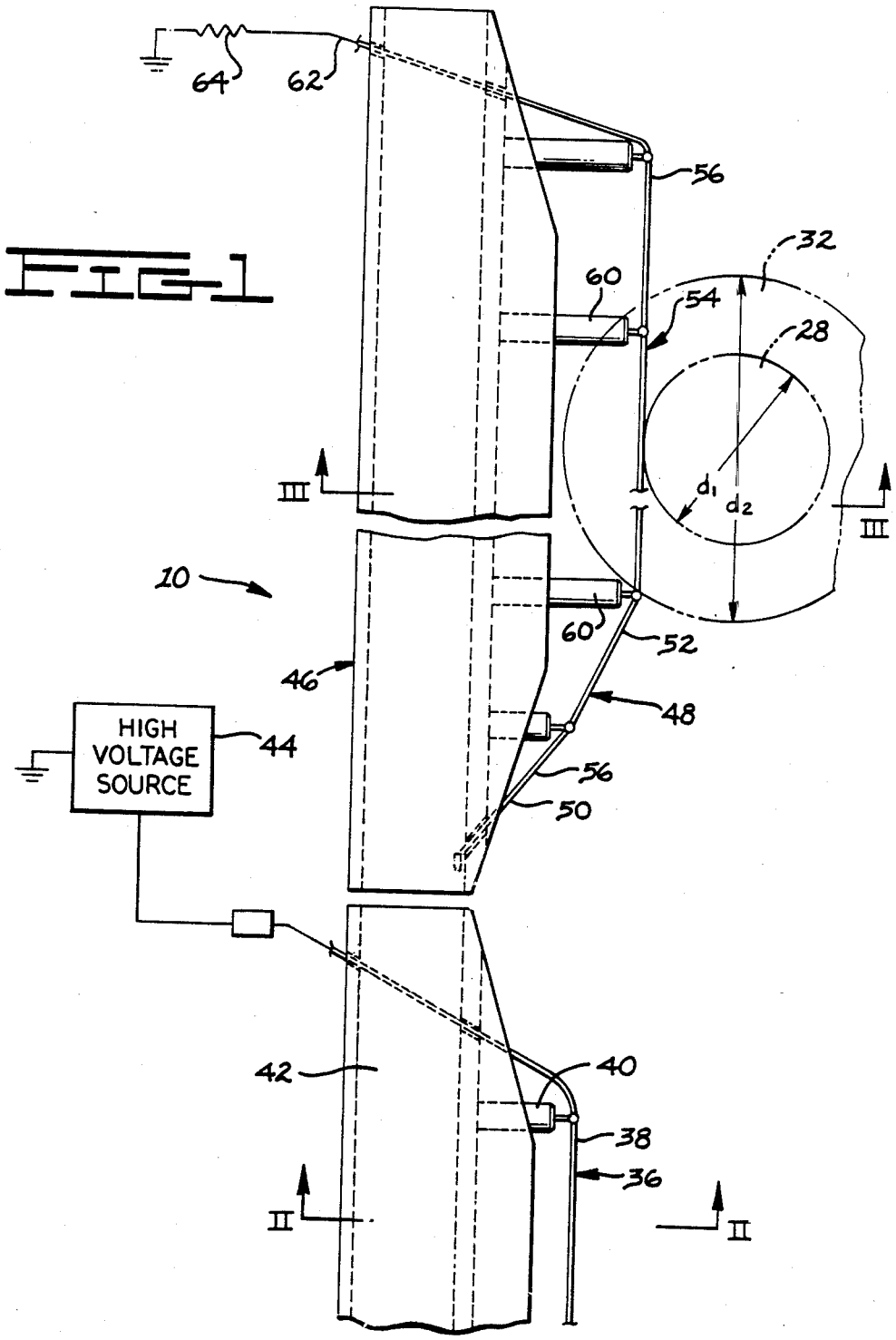
FIG. 1 is a partial plan view of an electrostatic coating system.

The electrostatic coating system 10 also includes an electrostatic charging zone 36 at an inlet of the path travelled by the workpiece supports 14 and associated charge collectors 28. As shown in FIGS. 1 and 2, the charging zone includes a thin wire conductor 38 supported by a plurality of stand-off insulators 40, mounted on a frame 42, and electrically connected to a high voltage source 44. The wire conductor 38 parallels the travel path of the workpiece supports 14, in spaced relationship to the supports, and is charged to a high electrical potential, for example, about 100,000 volts. As the workpiece supports 14 pass through the charging zone 36 a substantial portion of the voltage on wire 38 is induced on the charge collectors 28 and transferred through the conductive hook 26 to the workpieces 20. A typical inductive charging system is disclosed in the aforementioned U.S. Pat. No. 4,158,344 to Bagby, et al.

At an outlet of the path, i.e., subsequent to the path passing through the charging zone 36, the present invention includes a non-arcing electrical discharge zone 46. As shown in FIGS. 1 and 3, the discharge zone 46 includes an approach section 48 having an inlet end 50 and a spaced second end 52, and a contact section 54 adjoining the second end 52 of the approach section 48. The discharge zone also includes an elongated electrical conductor 56 mounted on the approach and contact sections 48,54. Preferably, the conductor 56 is a thin stainless steel wire having a diameter of about 0.13 mm. One end of the conductor is fastened to a non-conductive frame member 58 and is supported along its length in spaced relationship with the frame by a plurality of insulators 60. A second end 62 of the conductor 56 is electrically connected to one terminal of a resistor 64, the second terminal of the resistor being electrically grounded.

In the approach section 48, the elongated conductor is positioned in converging relationship with respect to the path of the charge collectors 28 that are mounted on and carried through the discharge zone 46 by the workpiece supports 14. At the inlet end 50 of the approach section 48, the elongate conductor 56 is spaced from path of the charge collectors 28. At the second end 52 of the approach section, the conductor 56 is adjacent the path of the charge collectors. The elongate conductor 56 extends through at least a portion of the contact section 54 adjacent the path of travel of the charge collector 28 so that the charge collectors physically and electrically contact the conductor 56 in the contact section in response to moving along the predetermined path through the discharge zone.

In the preferred embodiment the charge collectors 28 and electrically connected workpieces 20 enter the discharge zone 46 after being inductively charged in the charging zone 36. Typically, in the charging arrangement described above, the electrostatic charge on the collector and workpiece will be on the order of about 60–70 kV when entering the discharge zone. At the inlet end 50 of the approach section, the elongated conductor 56 is preferably spaced at least about 228.6 mm (9 inches) from the charge collectors, and rapidly close to 50 mm (2 inches) as they pass into the discharge zone 46. The conductor 56 then gradually converges towards the path of the passing collectors 28, until at the second end 62 of the approach section, physical contact is made with the collectors. The physical, and electrical, contact between the moving collectors 28 and the conductor 56 is then maintained as the collectors continue to move through the contact section 54 of the discharge zone. The rate of convergence of the conductor 56 with the path of the collectors in the approach section depends on several operating system parameters such as conveyor travel speed, magnitude of electrical charge, and the electrical capacitance characteristics of the workpiece and collector arrangement. The spatial separation between conductor 56 and collector 28 at the inlet end is selected so that the distance is greater than the arc-over, or sparking distance between the two members. As the collector advances from the inlet end 50 towards the second end 52 along the predetermined path fixed by the conveyor 12, the distance between the collector and conductor gradually decreases and the charge carried by the collector and associated workpiece will be increasingly inductively imposed on the conductor. The rate at which the charge induced on the conductor 56 can be transferred to ground, or zero potential, is limited by the resistance value of the resistor 64. In the preferred embodiment of the present invention the resistor 64 between the conductor 56 and ground has a value of 2500 megohms. The electrical capacitance of the thin wire conductor is small compared with the capacitance of the collector and workpiece, and the electrical charge on the conductor 56 will increase as the collector moves closer to the conductor and approach the electrical potential of the collector. Finally, both members will be at about the same electrical potential as the collector 28 moves into actual contact with the conductor.

After initial contact at the second end of the approach section, contact between the collector 28 and conductor 56 is maintained as the collector moves along its predetermined path through the contact section 54 of the discharge zone 46. The conductor 56 in the contact section may optionally be formed of a rigid metal bar or other structure that is heavier than the relatively thin wire conductor to provide increased wear resistance. Contact between the two members is maintained for a length of time sufficient to allow the charge on the workpiece 20, collector 28 and conductor 54 to be dissipated through the resistor 64 to ground. Typically, the time period sufficient to reduce the charge to near zero potential is about 3 to 4 seconds.

INDUSTRIAL APPLICABILITY

The present invention is useful in removing electrostatic charges from coated workpieces in systems that charge the workpiece during the coating process. In particular, the disclosed embodiment avoids the need for complex switching arrangements or the need for individual bleeder resistors associated with each workpiece support member.

Other aspects, objects and advantages of this invention can be obtained from a study of the drawings, the disclosure and the appended claims.

We claim:

1. In an electrostatic coating system having a conveyor arranged for moving a plurality of workpiece supports along a predetermined path, each of the supports having a first end operatively attached to the conveyor and a second end adapted for supporting a workpiece, an electrostatic charge collector on each of the supports between the first and second ends, means for electrically connecting each of the collectors to its respective workpiece, and means defining an electrostatic charging zone at an inlet of the path, the improvement comprising:

means defining a non-arcing electrical discharge zone at an outlet of the path and so arranged that the electrostatic charge collectors pass through the discharge zone subsequent to passing through the charging zone and having an electrostatic charge imposed thereon, the discharge zone means including an elongate electrical conductor extending along a portion of the path, a resistor, means for connecting one end of the resistor to the conductor and the other end to ground, an approach section having an inlet end, and a spaced second end, a portion of said conductor extending between the inlet and second ends in a converging relationship with respect to the predetermined path, the conductor at the inlet end of the approach section being spaced from the path a distance greater than the arcing distance of the electrostatic charge on the charge collector and at the second end being at the path, and a contact section adjoining the converging approach section and extending along the path, positioned so that the electrical charge collectors are in electrical contact therewith substantially along the entire length of the contact section as the collectors pass through the electrical discharge zone, whereby as the supports pass along the path through the approach section the collectors continually converge upon the conductor before contacting the conductor at the contact section of the discharge zone.

2. The electrostatic coating system as set forth in claim 1, wherein each of said supports has a first portion formed of a substantially electrically non-conductive material, said first portion being disposed between said first end and said charge collector, and a second portion formed of an electrically conductive material, said second portion extending between the charged collector and said second end.

3. The electrostatic coating system as set forth in claim 2, wherein the charge collector on each of said supports is a substantially planar disc-shaped member having a predetermined diameter and a central axis passing through the mid-point of said diameter and perpendicular to the planar surfaces of said collector, and said non-conductive first portion of each of the supports includes a cylindrically-shaped shield having a diameter greater than the diameter of said collector and a central axis passing through the mid-point of said diameter, the central axis of said collector being coaxially aligned with the central axis of said shield.

4. The electrostatic coating system as set forth in claim 1, wherein said elongate conductor is a wire having a diameter of about 0.13 mm and said resistor connected between said conductor and ground has a value of 2500 megohms ($2.5 \times 10^9$ ohms)

5. An apparatus for removing an electrostatic charge from a charge collector adapted for travel along a predetermined path, including:

an approach section having an inlet end and a spaced second end;

a contact section contiguous with the second end of said approach section;

an elongate electrical conductor mounted on said approach and contact sections, in spaced relationship with the path of said charge collector at the inlet end and adjacent the path of the collector at the second end of said approach section and positioned in converging relationship with the path of said collector from said inlet end to said second end, the elongate conductor also extending through at least a portion of said contact section and positioned adjacent to said path so that the electrical charge collectors electrically contact the conductor in said contact section in response to moving the collectors along the predetermined path; and an electrical resistor connected between said conductor and ground.

6. The apparatus, as set forth in claim 5, wherein said elongate conductor is a wire having a diameter of about 0.13 mm.

7. The apparatus, as set forth in claim 5, wherein said electrical resistor has a resistance value of about 2500 megohms.

* * * * *